United States Patent [19]

Workman

[11] 4,209,342

[45] Jun. 24, 1980

[54] DYNAMIC CLEANING METHOD AND APPARATUS FOR REMOVAL OF REMNANT MATERIAL

[75] Inventor: David B. Workman, Layton, Utah

[73] Assignee: Sperry Corporation, New York, N.Y.

[21] Appl. No.: 921,923

[22] Filed: Jul. 3, 1978

[51] Int. Cl.[2] ..... B08B 7/04

[52] U.S. Cl. ..... 134/10; 134/33; 134/36; 134/139; 134/102; 134/104

[58] Field of Search ..... 134/153, 138, 139, 152, 134/102, 104, 108, 105, 111, 33, 10, 157, 36, 37, 159, 99, 141, 61; 210/194, 195 R; 366/101

[56] References Cited

U.S. PATENT DOCUMENTS

| | | | |
|---|---|---|---|
| 2,774,362 | 12/1956 | Nordling | 134/153 |
| 2,788,008 | 4/1957 | Wanzer | 134/102 |
| 2,823,682 | 2/1958 | Coulter | 134/153 |
| 2,891,561 | 6/1959 | Hagans | 134/102 |
| 3,041,212 | 6/1962 | Booth | 134/153 |
| 3,435,835 | 4/1969 | Hobbs | 134/159 |
| 3,615,824 | 10/1971 | Hittel et al. | 134/10 |
| 3,635,143 | 1/1972 | Talley et al. | 134/138 |

*Primary Examiner*—S. Leon Bashore
*Assistant Examiner*—Michael Goldman
*Attorney, Agent, or Firm*—John P. Dority; William E. Cleaver; Marshall M. Truex

[57] ABSTRACT

A system for dynamic cleaning of remnant material from a product, such as densely packaged electrical assemblies, employs a receptacle for containing cleaning fluid and a rack rotatably mounted in the receptacle for holding the product to be cleaned. The receptacle is divided by an upright transverse wall into first and second reservoirs, with the product being rotatably mounted by the rack in the first reservoir. A pair of conduits having openings facing upwardly toward a side of the product are mounted in the first reservoir adjacent to one another and extend transversely across the receptacle below the product. A blower forces a pressurized flow of a gaseous medium through a first one of the conduits and the openings therein toward the product side, while a pump forces a pressurized flow of cleaning liquid through a second one of the conduits and the openings therein toward the same product side. These flows coact to cause bubbles of gaseous medium to be driven into and through the product by said cleaning liquid which causes the product with its supporting rack to rotate and remnant material to be dislodged and removed from the product. The remnant material flows with excess fluid from the first reservoir both over and under the upright wall into the second reservoir where the material is collected. Another pair of conduits respectively provide paths for returning the gaseous medium from the receptacle above the fluid level to the blower and fluid from the second reservoir to the pump.

29 Claims, 10 Drawing Figures

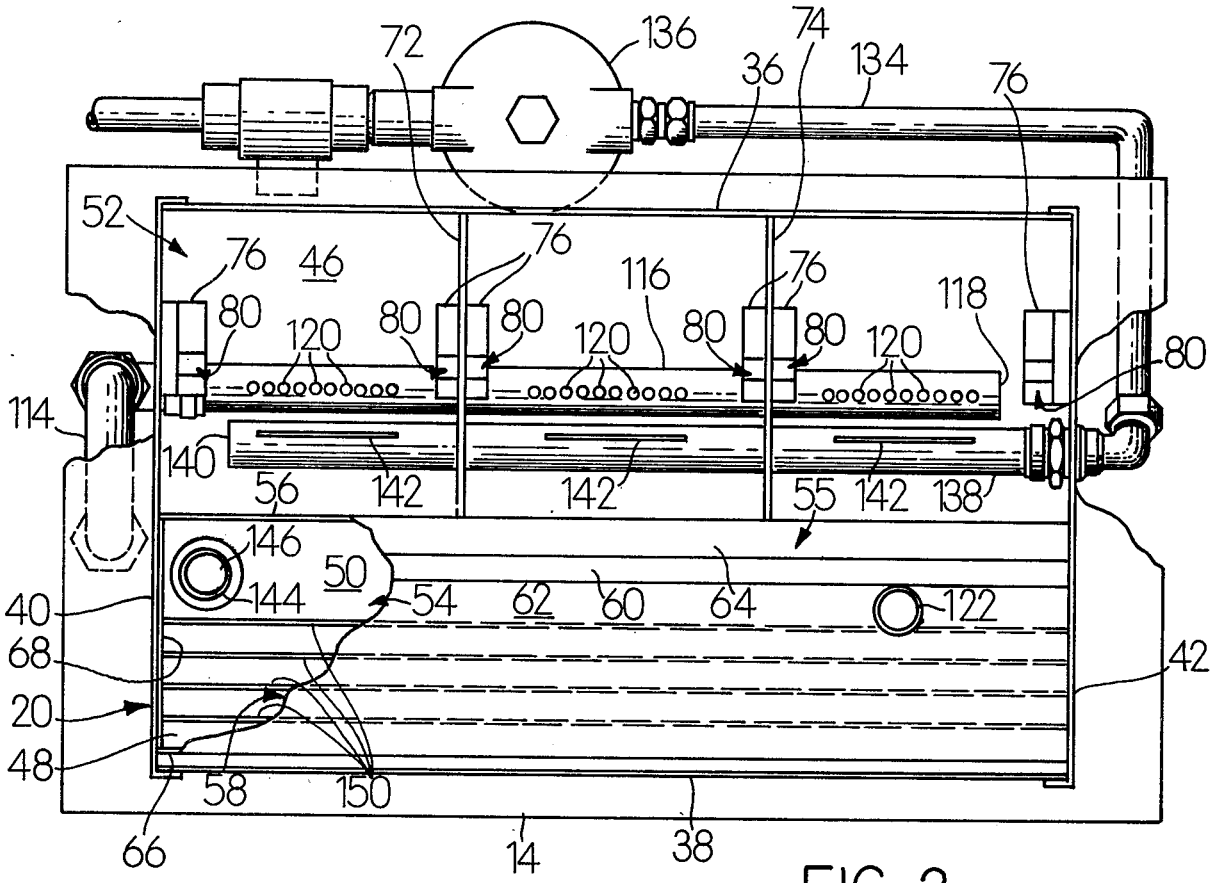
FIG. 2
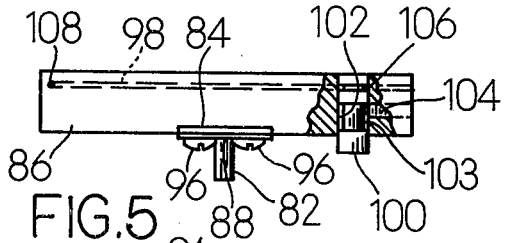
FIG.5
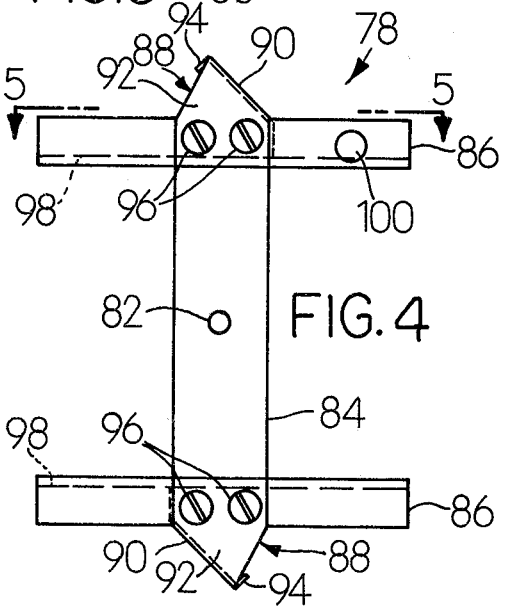
FIG. 4
FIG. 3
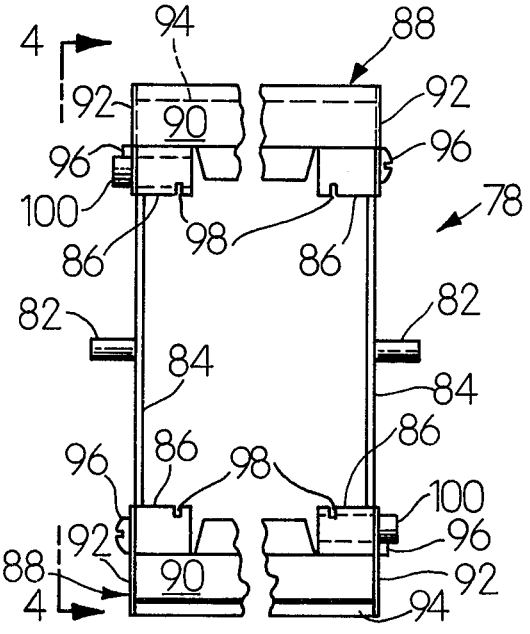

DYNAMIC CLEANING METHOD AND APPARATUS FOR REMOVAL OF REMNANT MATERIAL

BACKGROUND OF THE INVENTION

1. Field of the Invention

The present invention generally relates to the elimination of foreign or remnant particles which normally remain in a product, such as densely packaged electrical assemblies, as a consequence of its particular manufacturing process and, more particularly, is concerned with a dynamic cleaning system that effectively penetrates the densely packaged product and gently removes the remnant particles or material.

2. Description of the Prior Art

Products, such as densely packaged electrical or mechanical assemblies and the like, usually contain a multitude of internal spaces, gaps, void areas, etc., wherein remnant material may become lodged or trapped as a consequence of their manufacturing processes. One example of such a product is a core memory stack for the UYK-7 computer manufactured by the Sperry Univac Division of Sperry Rand Corporation for the Department of the Navy. A typical stack is a four-inch cube in size, containing over 137,000 parts, nearly 2,000 feet of electrical wire and having over 14,000 electrical connections. Loose metallic particles and other remnant material, oftentimes microscopic in size, are commonly left in the core memory stack from the manufacturing process. These particles, whether tiny balls of solder, silvers of plating or loose wire clippings, can temporarily bridge circuit paths causing intermittent failures in the stack. Hence, the presence of these remnant particles in the product will ordinarily greatly affect the reliability of the product.

Conventional techniques for removing remnant material from products include submerging the product in a solvent bath and then vigorously agitating the bath through use of ultrasonics or by introducing air into it. Both of these techniques are less than satisfactory as a system for effectively cleaning the product. Ultrasonic systems sometimes cause damage to sensitive or fragile components in the product, while air bubbling type systems which simply cause turbulence in the solvent bath by injection of air oftentimes fail to penetrate internal areas of the product uniformly. In both ultrasonic and simple air bubbling type systems, particles are often loosened within the product but are left lying on the inside. This is caused by a lack of directional solvent flow within the product.

SUMMARY OF THE INVENTION

The present invention provides a dynamic cleaning system that effectively penetrates the densely packaged product, loosens entrapped remnant particles and gently carries them to outside the product and thereby overcomes the deficiencies that have been experienced with the above-mentioned conventional techniques.

In the development of the present invention, it has been found that a dynamic cleaning system must have the following capabilities if it is to effectively penetrate and remove particles from within the product:

(1) Dissolving power—the cleaning solvent used in the system must be capable of dissolving materials that may be temporarily bonding particles within the product.

(2) Internal agitation—the cleaning system must cause the solvent to agitate within the product in order to lift particles out of tiny crevices and spaces between circuit paths or mechanical components of the product.

(3) Internal directional flow—the cleaning solvent must have directional flow within the product in order to move particles from within to the outside of the product.

(4) Particle carrying ability—the cleaning mediums must have the ability to pick up remnant particles and carry them to the outside of the product.

(5) External directional flow—the cleaning tank or receptacle should also be designed to provide for directional solvent flow which moves particles away from the cleaning area. There would be no advantage in removing a particle if it is allowed to later recontaminate the product.

The dynamic cleaning system of the present invention incorporates features which provide for these five basic cleaning capabilities. The dissolving power capability is easily achieved through use of any one of many commercially-available cleaning solvents. The other four of the above-outlined cleaning capabilities are the major achievements of the cleaning system of the present invention. Additional achievements are found in features providing for recirculation of the cleaning mediums and for preventing pollution of the external atmosphere in the area where the system is used by noxious solvent fumes.

Accordingly, the present invention provides a method and apparatus for cleaning remnant particles or material from a product, such as densely packaged electrical assemblies.

The cleaning apparatus comprising a tank or receptacle for containing a cleaning fluid, means rotatably mounted in the receptacle for holding a product to be cleaned and means connected in communication with the receptacle for directing a gaseous medium and cleaning fluid through the fluid in the receptacle and toward and against the product, such as an underside of the product, which causes rotation of the product with the rotatably mounted means and removal of remnant material from the product. More particularly, means, such as an upright wall, is mounted in the receptacle for dividing the receptacle into first and second reservoirs and for providing a path of flow of excess fluid from the first to second reservoir. There is also provided means disposed in communication with the receptacle for cooling the gaseous medium and fluid in the receptacle as well as means disposed in communication with the receptacle and with the gaseous medium and fluid directing means for respectively providing return of gaseous medium from the receptacle and fluid from the second reservoir thereof to the directing means which facilitates reuse of the same gaseous medium and fluid by the directing means. Also, the receptacle in the second reservoir thereof includes means for collecting the remnant material removed from the product.

The cleaning method comprises the steps of rotatably mounting a product to be cleaned in a receptacle which contains a cleaning fluid, introducing a gaseous medium and cleaning fluid into the receptacle so as to cause portions thereof to impinge against the product, such as against an underside of the product, and rotating the product during the impingement of the introduced gaseous medium and cleaning fluid against the product so as to cause dislodgment and removal of remnant material from the product. More particularly, the gaseous medium and cleaning fluid are introduced under pressure into a first reservoir of the receptacle within which the product is mounted and toward the product so as to cause portions of the introduced gaseous medium and fluid to impinge against the product, remove remnant material therefrom and cause flow of the remnant material along with excess fluid from the first reservoir to a second reservoir of the receptacle. Additionally, the method includes the steps of recirculating the excess fluid from the second reservoir for reintroduction into the first reservoir, recirculating the gaseous medium from the receptacle for reintroduction into the first reservoir and collecting within the second reservoir the remnant material removed from the product.

BRIEF DESCRIPTION OF THE DRAWINGS

FIG. 2 is a top plan view of the system as seen along line 2—2 of FIG. 1.

FIG. 3 is a fragmentary top plan view of a rack for holding the product to be cleaned in the receptacle of the system of FIG. 1.

FIG. 4 is a side elevational view of the rack as seen along line 4—4 of FIG. 3.

FIG. 5 is a view taken along line 5—5 of FIG. 4.

DETAILED DESCRIPTION OF THE INVENTION

Figure 1:
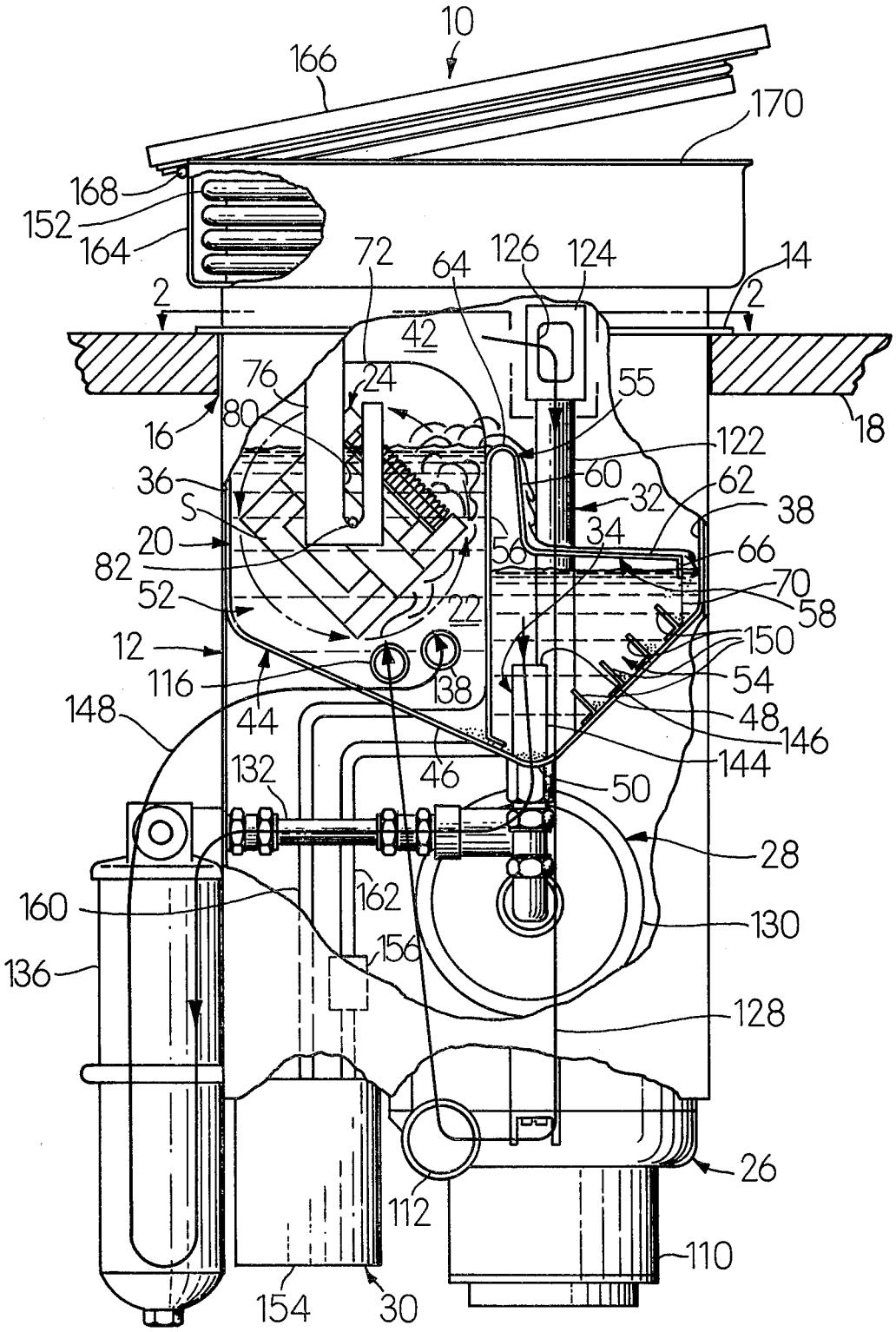
FIG. 1 is a side elevational view of a dynamic cleaning system constructed in accordance with the principles of the present invention, with portions broken away and omitted for purposes of clarity and with lines and arrows schematically representing the flow paths of the gaseous medium and cleaning fluid in the system.
Figure 6:
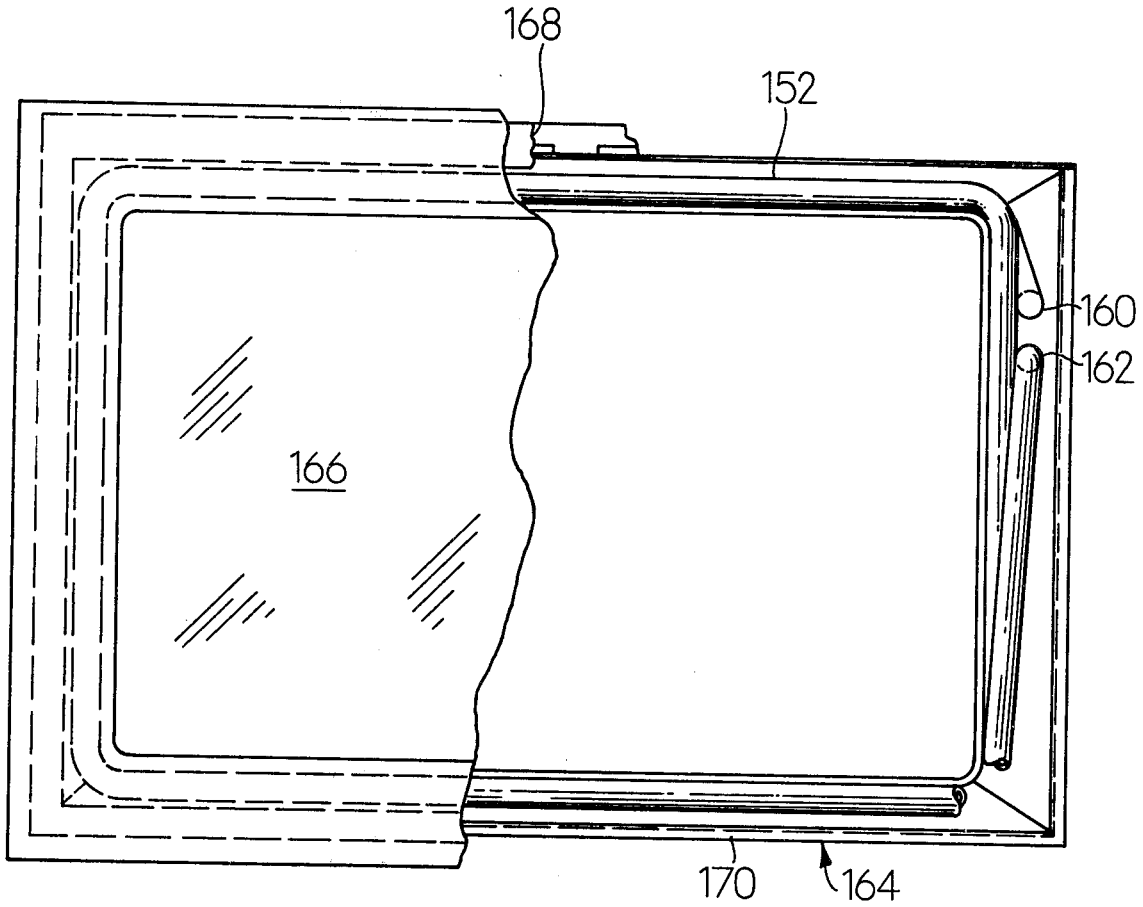
FIG. 6 is a top plan view of the system of FIG. 1 with a cover hinged to one edge of a refrigeration unit housing being partially broken away to expose details of the coil of the refrigeration unit.

Referring now to the drawings, and particularly to FIG. 1, there is shown a dynamic cleaning system, generally designated 10, comprising the preferred embodiment of the present invention. The components of the system 10, to be described shortly, are attached to a rectangular housing 12 which has an upper, outwardly-projecting peripheral flange 14. The housing 12 is supported through a rectangular opening 16 formed in the counter top 18 of a stand by its flange 14 which rests on a marginal portion of the counter top 18 which surrounds the opening 16 formed in the counter top 18.

The components of the system 10 supported by the housing 12 include a tank or receptacle 20 containing a quantity of cleaning fluid or solvent 22, such as Freon TES produced by DuPont, a rack 24 rotatably mounted in the receptacle 20 for holding a product, such as a core memory stack S, first means, generally designated 26, connected in communication with the receptacle 20 providing a source of a gaseous medium, such as an air/solvent vapor mixture, under pressure for introduction into the receptacle 20, and second means, generally designated 28, connected in communication with the receptacle 20 providing a source of cleaning fluid under pressure for introduction into the receptacle 20. Also, other components of the system 10 include refrigeration means, generally designated 30, disposed in communication with the receptacle 20 for cooling the gaseous medium and cleaning fluid in the receptacle 20, third means, generally designated 32, diposed in communication with the receptacle 20 and connected to the gaseous medium source 26 for providing return to the latter of the introduced gaseous medium so that the source 26 can reintroduce the same to the receptacle 20, and fourth means, generally designated 34, connected in communication with the receptacle 20 and the cleaning fluid source 28 for providing return to the latter of the introduced fluid so that the source 28 can reintroduce the same to the receptacle 20.

Turning now to FIG. 2 as well as to FIG. 1, it can be seen that from above, the receptacle 20 has a rectangular shape, being formed by opposite front and rear walls 36, 38 being interconnected by opposite side walls 40, 42. A bottom wall, generally designated 44, of the receptacle 20 is formed by front and rear oppositely inclined bottom wall portions 46, 48 which respectively merge from the lower edges of the front and rear vertical walls 36, 38 and interconnect the opposite vertical side walls 40, 42 and by a middle arcuately-shaped bottom wall portion 50 which is lower than and merges with the front and rear bottom wall portions 46, 48 and also interconnects the vertical side walls 40, 42.

The receptacle 20 is divided into first and second reservoirs generally designated 52 and 54, by a partitioning means, generally designated 55, which includes an upright wall portion 56 which extends longitudinally across the receptacle 20 between the opposite vertical side walls 40, 42 thereof. The lower edge of the upright wall portion 56 is turned toward the second reservoir 54 and spaced above the front inclined bottom wall portion 46. This space allows laminar solvent flow under wall portion 56 to remove heavy, nonfloating particles away from the cleaning area of the first reservoir 52 to the second reservoir 54. Also, the partitioning means 55 includes an arcuate-shaped wall portion 58 which is connected to the upper end of the upright wall portion 56 and is comprised by a generally vertically-extending part 60 and a generally horizontally-extending lower part 62. The vertical part 60 merges with the upper end of the upright wall portion 56 so as to form a curved waterfall type surface 64 over which excess fluid will flow during operation of the cleaning system 10. The vertical part 60 extends downwardly in a slightly divergent relationship away from the upright wall portion 56 to where it merges with the lower horizontal part 62 of wall portion 58. The lower horizontal part 62 extends toward the rear wall 38 of the receptacle 20 but terminates in a downwardly turned edge 66 which is spaced from the rear wall 38. Together, the parts 60, 62 of the arcuate wall portion 58 provide a path for generally laminar flow of excess fluid from the first reservoir 52 of the receptacle 20 to a region of the second reservoir 54 thereof which is remotely-located from the first reservoir 52. Further, the partitioning means 55 includes side wall portions 68, 70 which are respectively connected to the opposite sides of the upright wall portion 56 and arcuate wall portion 58 and disposed contiguous with the side walls 40, 42 of the receptacle 20 within the second reservoir 54 thereof. The partitioning means side wall portions 68, 70 are supported on the middle and rear bottom wall portions 50, 48 of the receptacle bottom wall 44 which also define the bottom of the second reservoir 54. The front bottom wall portion 46 of the receptacle bottom wall 44 defines the bottom of the first reservoir. The above-described wall portions of the partitioning means 55 define a unitary structure which may be removed from the receptacle 20 for facilitating maintenance and cleaning of the same.

In the preferred embodiment, the first reservoir 52 of the receptacle 20 is separated into three compartments by a pair of plates 72, 74 which are equidistantly spaced apart from each other and from the respective adjacent one of the side walls 40, 42 of the receptacle 20. The plates 72, 74 are connected to and extend from the front wall 36 and the front bottom wall portion 46 of the receptacle 20 toward and in contact with the front side of the upright wall portion 56 of the partitioning means 55. In such arrangement, the plates 72, 74 provide lateral support for the upright wall portion 56.

Within each of the compartments of the first reservoir 52 may be rotatably mounted a product, such as the above-mentioned memory core stack S. For mounting the products in the three compartments, three pairs of brackets 76 are attached to the interior surfaces of the receptacle side walls 40, 42 and to opposite surfaces of the plates 72, 74; and three racks 24 are provided for respectively rotatably and removably mounting the products to the pairs of brackets 76. Each of the brackets 76 has a U-shaped configuration which defines an upwardly-opening vertical slot 80 therein. The brackets 76 in each respective pair thereof are disposed such that their respective slots 80 are aligned for receiving a pair of opposite outwardly-extending coaxial spindles 82 of one of the racks 24. Each of the spindles 82 of a rack 24, when the latter is installed in one of the reservoir compartments, will rest on the interior curved surface of the bracket 76 which defines the bottom of the slot 80 and may rotate thereon when the rack 24 and the product S held by the rack 24 are caused to rotate during operation of the system 10.

The configuration of the racks 24 will be dependent to a certain extent upon the configuration of the products which they are intended to hold. Thus, the racks may take any of a variety of constructions. One specific construction of the racks is shown in FIGS. 3 through 5. This constructions, being designed to hold the memory core stack product S, depicted in schematical form in FIG. 1, is merely exemplary of this component of the system 10 of the present invention.

The rack 24 includes a pair of spaced apart side members 84 at the midpoints of which are respectively attached the outwardly-extending coaxially aligned spindles 82. At opposite ends of each of the side members 84 is attached a pair of rail members 86 in perpendicular relationship to the longitudinal extent of the side member 84. A transverse member, generally designated 88, extends between the respective ones of the pairs of rail members 86 at corresponding ends of the side members 84. Each transverse member 88 includes a main planar portion 90 and in-turned tab portions 92 at the opposite ends of the planar portion 90. The planar portion 90 of each transverse member 88 has an in-turned longitudinal edge 94 which provides the member 88 with structural rigidity. The tab portions 92, along with the respective opposite ends of the side members 84, are attached to the midsection of the respective rail members 86 by screws 96. With the tab portions 92 of each transverse member 88 attached to the respective rail members 86, the main planar portion 90 of each transverse member 88 is disposed parallel to the axis of the rack 24 defined by the spindles 82 but at an angle to the longitudinal extent of the respective rail members 86 to which the transverse member 88 is attached. The planar portions 90 of the respective transverse members 88 serve as paddle wheel type surfaces against which fluid is impinged for facilitating more positive and constant rotation of the rack 24 and the product held thereon.

With the above-described arrangement of its parts, the rack 24 has a generally square configuration for holding the cube-shaped core stack S. Parallel edge portions of the core stack (not shown) are received in respective aligned grooves 98 formed in facing longitudinal surfaces of the pairs of rail members 86, as seen in FIG. 3. Two diagonally disposed rail members 86 of the racks 24 each having a movable button 100 disposed in a transverse bore 102 formed therethrough adjacent one end and intersecting its groove 98. The button 100 has a circumferential recessed area 103 into which a set screw 104 mounted in the rail member end extends for limiting axial movement of the button 100 and thereby preventing it from being inadvertently removed from the rail member 86. The button 100 also has a circumferential groove 106 which is aligned with the rail member groove 98 and allows insertion or removal of the core stack product on or from the rack 78 when the button is in a first position, as seen in FIG. 5. After the stack product has been inserted on the rack 78 and it is desired to prevent its removal therefrom, the button is axially moved (upwardly in FIG. 5) to a second position so as to misalign its groove 106 with the groove 98 of the rail member 86 and thereby obstruct the groove 98. Also, each of the two diagonal rail members 86 which have the movable button 100 also have a pin 108 mounted adjacent their other opposite ends so to provide a stop which obstructs their grooves 98. Thus, the pin 108 and button 100 of each of the two rail members 86 ensure retention of the product on the rack 24 during operation of the system 10.

As briefly mentioned above, first and second means 26, 28 are provided in communication with the receptacle 20 for introducing a gaseous medium and cleaning fluid, respectively, under pressure into the receptacle 20. When the product S is inserted and retained on a rack 24 and the latter is installed on the brackets 76 in one of the compartments of the first reservoir 52 of the receptacle 20, the first and second means 26, 28 are arranged to direct the gaseous medium and cleaning fluid in a stream toward a side of the product. Impingement of the stream against the product side, preferably at a pressure of thirty inches of water for the fluid and twelve inches of water for the gaseous medium, causes the rack 24 and the product therewith to rotate about the axis defined by the spindles 82 of the rack 24. It will be seen that during rotation of the rack 24 and product, the stream also impinges against the planar portions 90 of the rack transverse members 88 which ensure uniform rotation of the rack 24 and product.

The source of the gaseous medium under pressure is provided by a blower 110 of the first means 26. The blower 110 mounted to the housing 12 below the receptacle 20 may be of the type commercially available from the Lamb Electric Division of Ametek, being designated by Model Number 115837, as modified by incorporating a seal composed of a Viton O-ring turning inside a graphite-impregnated housing and by replacing the electric motor with an air motor.

As seen in FIGS. 1 and 2, pressure port 112 of the blower 110 is connected in communication by a first conduit 114 to the first reservoir 52 of the receptacle 20. The first conduit 114 has an extension 116 which is closed at its terminal end 118 and is disposed in the first reservoir 52 of the receptacle 20. The conduit extension 116 spans all three compartments of the first reservoir 52 in close proximity to its front inclined bottom wall portion 46 so as to allow sufficient space for a rack 24 and the product held thereon to be installed above it in any or all of the first reservoir compartments. As seen in FIG. 2, the conduit extension 116 has a series of small openings 120 formed therein so as to face toward a product within each of the first reservoir compartments. Quantities of the gaseous medium are continuously forced by the blower 110 from the conduit extension 116 through these openings 120 and introduced into the first reservoir 52 against a side of the product located in close proximity to the openings 120. As the introduced gaseous medium encounters fluid contained in the receptacle 20, bubbles of the gaseous medium are formed. Since the direction of flow of the bubbles from the conduit extension openings 120 is upward toward the product, the same as would naturally occur when any gaseous medium is introduced into a fluid medium of greater density, penetration by the bubbles occurs into all exposed openings, spaces, gaps, etc., within the production as they rise toward the surface of the fluid 22 contained in the first reservoir 52.

The gaseous medium is returned from the receptacle 20 to a vacuum inlet port (not shown) of the blower 110 by the above-mentioned third means 32 which takes the form of a second conduit 122. The second conduit 122 is connected at its lower end to the blower vacuum inlet port and extends vertically therefrom through the second reservoir 54 of the receptacle 20 and the wall portion 58 of the partitioning means 55, as seen in FIGS. 1 and 2, to an upper end portion 124 which is disposed above the level of the fluid 22 in the receptacle 20 and has an opening 126 formed therein. The gaseous medium flows into the second conduit 122 through its upper opening 126 from the receptacle 20 because of a suction type flow created by the blower 110 at its inlet port. In such manner, as depicted by the path 128 in FIG. 1, the gaseous medium is recirculated from the receptacle 20 to the blower 110 for reintroduction into the first reservoir 52 of the receptacle 20.

The source of cleaning solvent or fluid 22 under pressure is provided by a pump 130 of the second means 28. The pump 130 mounted to the housing 12 below the receptacle 20 may be of the type commercially available from W. W. Granger Incorporated being designated by Model Number 1P787. The second means 28 further includes first and second conduits 132, 134 and a filter 136. As seen in FIG. 1, a pressure outlet port of the pump 130 is connected in communication to an inlet port of the filter 136 by the first conduit 132. An outlet port of the filter 136 is connected in communication with the receptacle 20 by the second conduit 134. The second conduit 134 has an extension 138 which is closed at its terminal end 140 and is disposed in the first reservoir 52 of the receptacle 20. The second conduit extension 138 spans all three compartments of the first reservoir 52 in close proximity to its front inclined bottom wall portion 46 and alongside the first conduit extension 116 so as to allow sufficient clearance for installation of a rack 24 and the product held thereon above it. As seen in FIG. 2, the second conduit extension 138 has openings in the form of elongated slots 142 formed therein so as to face toward a product within each of the first reservoir compartments. Quantities of the cleaning fluid are continuously forced by the pump 130 from the conduit extension 138 through these slots 142 and introduced into the first reservoir 52 against a side of the product located in close proximity to the slots 142.

The coaction of the introduced gaseous medium and cleaning fluid medium under pressure produces a stream which impinges against the product side and rack transverse members 88 and causes the same to rotate. The two mediums, differing greatly in density tend to drive one another in penetrating the empty spaces within the product as it rotates. This action forces out cleaning fluid already within the product and dislodges and removes remnant particles or material from the product.

As the fluid within the first reservoir 52 rises to the level of the curved surface 64 of the partitioning means 55, excess fluid flows over the surface 64 and down and across the arcuate-shaped wall portion 58 of the partitioning means 55 and into the second reservoir 54.

The fluid is returned from the second reservoir 54 of the receptacle 20 to a vacuum inlet port (not shown) of the pump 130 by the above-mentioned fourth means 34 which takes the form of a third conduit 144. The third conduit 144 is connected at its lower end to the pump vacuum inlet port and extends vertically therefrom into the second reservoir 54, as seen in FIGS. 1 and 2, to an upper open end 146 which is disposed below the level of the fluid in the second reservoir 54. The fluid flows into the third conduit 144 through its upper open end 146 from the second reservoir 54 because of a suction type flow created by the pump 130 at its inlet port. In such manner, as depicted by the path 148 in FIG. 1, the cleaning fluid is recirculated from the second reservoir 54 to the pump 130 for reintroduction into the first reservoir 52. Any microscopic particles in the fluid are removed by the filter 136 before reintroduction of the fluid into the first reservoir 52.

The remnant particles or material dislodged and removed from the product in the first reservoir 52 is collected in the second reservoir 54. Heavier particles sink to the bottom of the first reservoir 52 and migrate down the front inclined bottom wall portion 46, move under the lower edge of the upright wall portion 56 of the partitioning means 55 and settle on the surface of the middle bottom wall portion 50 within the second reservoir 54. Lighter particles are carried along with the flow of excess fluid over the curved surface 64 and across the wall portion 58 of the partitioning means 55, and into the second reservoir 54 at the region thereof remote from the first reservoir 52. Extending perpendicularly upwardly from and transversely across the rear inclined bottom wall portion 48 is a series of plates 150 for collecting some of the remnant particles flowing with the excess fluid into the second reservoir 54. The plates 150 are disposed adjacent the path of fluid flow into the second reservoir so as to catch the particles as they settle toward the bottom wall portions 48 and 50 of the second reservoir 54. Periodically the partitioning means 55 may be removed from the receptacle 20 for cleaning out the collected remnant particles from the regions of collection, i.e., the middle bottom wall portion 50 and the plates 150.

Figure 7:
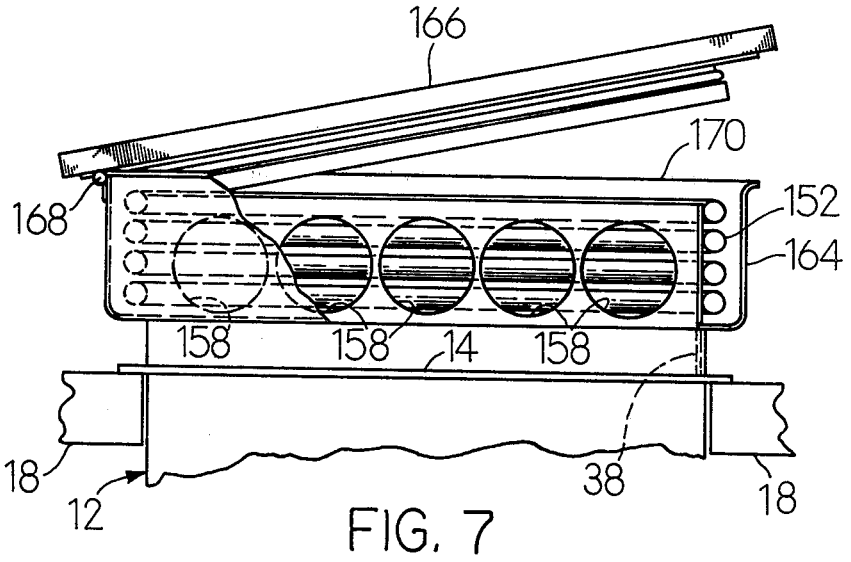
FIG. 7 is a side elevational view illustrating more details of the cover and refrigeration unit portion of the system than shown in FIG. 1.

Due to the action of the blower 110 and pump 130 as well as the agitation of the gaseous medium and cleaning fluid in the first reservoir 52, the temperature of the same increases during operation of the system 10. For keeping the temperature of the gaseous medium under control, there is provided the refrigeration means 30 which includes a continuous coil 152 connected with a compressor-condenser unit 154 and an expansion value 156. The unit 154 is attached to the housing 12. The coil 152 is disposed about upper portions of the front, rear, and left and right side walls 36, 38, 40 and 42 of the receptacle 20, the latter wall portions having large circular openings 158 formed therein, as shown in FIG. 7, for exposing the coil 152 to the gaseous medium, such being a mixture of air and solvent vapor. Suitable return and feed conduits 160, 162 interconnect the condenser unit 154 with opposite ends of the coil 152 for circulation of a suitable refrigerant therebetween, with the expansion value 156 being interposed in the feed conduit 162.

For sealing off the receptacle 20 from the external atmosphere during operation of the system 10, a casing 164 is attached to the upper end of the housing 12 and surrounds the refrigeration coil 152. A cover 166 is hinged at 168 along the front edge of the casing 164 which when closed rests on the rim 170 of the casing 164 and seals the top of the receptacle 20. When the system 10 is not operating, the cover 166 may be lifted upwardly to open the receptacle 20 for installing or removing the racks 24 and products held thereon to or from the receptacle 20, or for cleaning out of the remnant particles collected in the receptacle 20. The cover 166 is moved to its closed position during operation of the system 10 which facilitates recirculation of the gaseous medium within the system 10 and prevents the same from escaping to and polluting the external atmosphere. Also, with the cover 166 closed, the refrigeration means 30 will effectively control the temperature of the air/-solvent vapor mixture.

Figure 10:
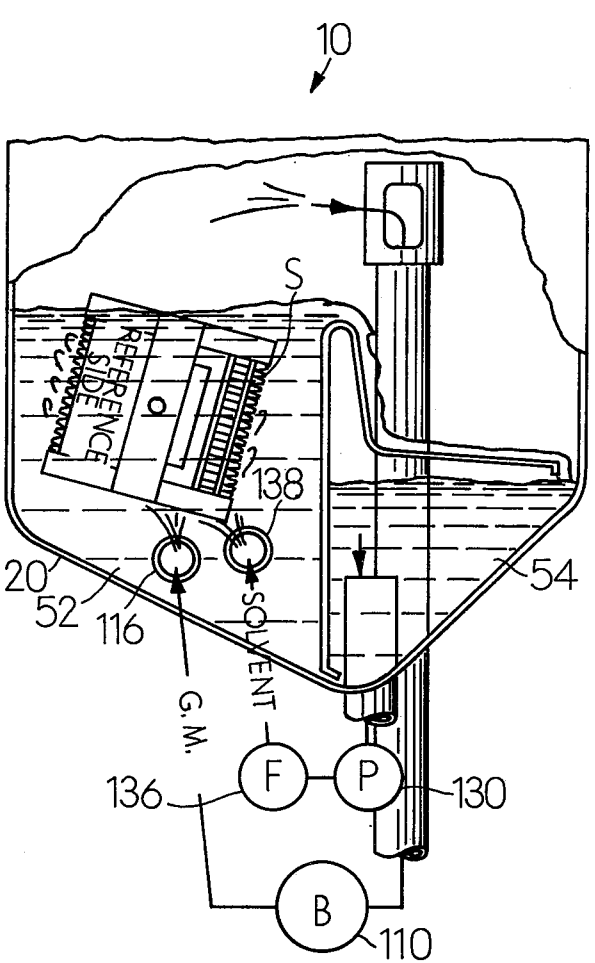
FIGS. 8 through 10 schematically depict the system of FIG. 1 during three successive stages in its operation.
Figure 9:
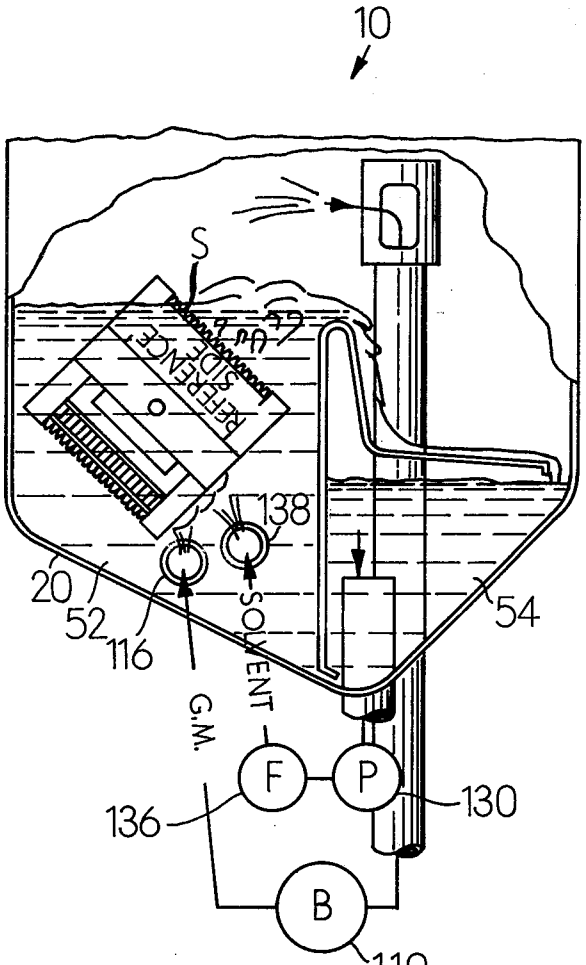
Figure 8:
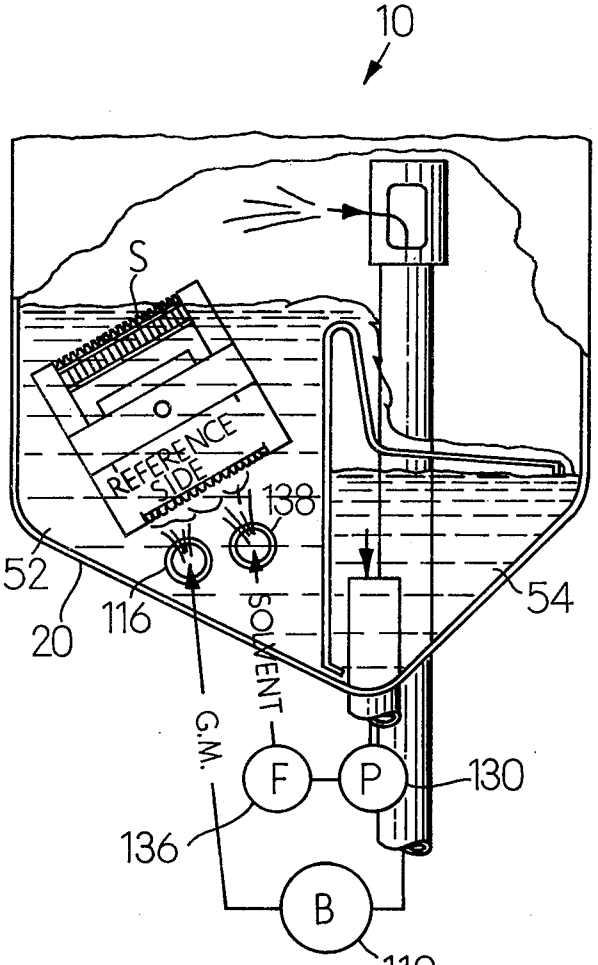

FIGS. 8 through 10 schematically depict three successive stages in the operation of the system 10 which provide effective cleaning of the rotating product held submerged in cleaning fluid in the first reservoir 52 of the receptacle 20.

In the first stage of FIG. 8, a reference side of the product is disposed directly above and facing the openings in the conduit extensions 116 and 138 for introducing the gaseous medium and cleaning fluid into the receptacle 20 and toward the product. The air/solvent vapor mixture comprising the gaseous medium is injected from extension 116 into the spaces within the product and forces out solvent fluid therein carrying with it some of the remnant particles. The bubbles formed upon injection of the gaseous medium easily penetrate the spaces, gaps, etc., within the product. The fluid solvent spray or stream from extension 138, also impinging the reference side of the product, drives the bubbles to the interior of the product and discourages them from floating up around the exterior of the product.

During the second stage of FIG. 9, as the product rotates in the counterclockwise direction, due to the continuous impingement of the gaseous medium and solvent cleaning fluid against the product and rack 24, with the reference side now advanced approximately one hundred twenty degrees from its position during the first stage, most of the previously injected bubbles rise out of the product interior, being replaced by solvent fluid. The surface tension around the bubbles aids in picking up microscopic particles and moving them to the exterior of the product where they flow with excess fluid into the second reservoir as the injected bubbles break from the surface of the fluid contained in the first reservoir 52.

In the third stage of FIG. 10 where the reference side of the product has advanced another approximately one hundred twenty degrees in the counterclockwise direction of rotation, the bubbles remaining within the interior of the product will now move in a direction substantially opposite to that moved in the first and second stages as the bubbles are driven out by more fluid reentering the product. This reversal of the direction of movement of the bubbles helps to dislodge trapped particles within the product. Rotation of the product, at a speed of approximately 40 RPM, through the first, second and third stages just described creates a directional solvent/bubble flow within the product that effectively picks up particles and carries them to the outside thereof.

The above-described system 10 has proven to be an extremely effective method of cleaning products such as densely packaged electrical assemblies. However, its basic cleaning capabilities are also believed to be equally applicable for cleaning sensitive mechanical products. A further modification within the purview of the present invention would be to provide means for positively rotating the rack and the product held thereon as may be desirable in applications where a nonsymmetrical product is to be cleaned.

Having thus described the invention, what is claimed is:

1. Apparatus for cleaning remnant particles or material from a product, such as densely packaged electrical assemblies, comprising:

a receptacle for containing a cleaning liquid;

a rack rotatably mounted in said receptacle for holding a product to be cleaned at least partially submerged in said cleaning liquid;

first means connected in communication with said receptacle for introducing a stream of a gaseous medium into said receptacle to directionally impinge upon said product;

second means adjacent said first means connected in communication with said receptacle for introducing a stream of said cleaning liquid into said receptacle to directionally impinge upon said product along with said stream of a gaseous medium;

said first and second means being operable to cause portions of said introduced gaseous medium and cleaning liquid to impinge against the product so as to cause said rack and the product therewith to rotate, to cause bubbles of said gaseous medium to be driven into and through said product by said stream of cleaning liquid and to cause bubbles of said gaseous medium remaining in said product to be driven in an opposite direction with respect to said product and out of said product by said stream of cleaning liquid as said product rotates, whereby remnant material is dislodged and removed from said product.

2. The apparatus as recited in claim 1, wherein said receptacle includes means for collecting the remnant material removed from the product.

3. The apparatus as recited in claim 1, further comprising third means disposed in communication with said receptacle and connected to said first means for providing return to said first means of said introduced gaseous medium so that said first means can reintroduce the same gaseous medium to said receptacle.

4. The apparatus as recited in claim 1, further comprising fourth means connected in communication with said receptacle and said second means for providing return to said second means of said introduced liquid so that said second means can reintroduce the same liquid to said receptacle.

5. Apparatus for cleaning remnant particles or material from a product, such as densely packaged electrical assemblies, comprising:

a receptacle for containing liquid cleaning solvent;

means rotatably mounted along an axis of rotation in said receptacle for holding a product to be cleaned at least partially submerged in said solvent;

first means connected in communication with said receptacle for directing a stream of a gaseous medium through said solvent to directionally impinge upon said product by said stream of solvent in a direction generally perpendicular to said axis of rotation;

second means adjacent said first means connected in communication with said receptacle for directing a stream of said solvent through the solvent contained in said receptacle to directionally impinge upon said product along with said stream of a gaseous medium, whereby rotation of the product with said rotatably mounted means occurs and bubbles of said gaseous medium are driven into and out of said product unidirectionally with respect to said receptacle and multidirectionally with respect to said product to enhances removal of remnant material from said product.

6. The apparatus as recited in claim 5, further comprising means connected to said receptacle for collecting remnant material removed from the product.

7. The apparatus as recited in claim 5, further comprising means disposed in communication with said receptacle and with said gaseous medium and solvent directing means for providing return of gaseous medium and solvent from said receptacle to said directing means which facilitates reuse of the same gaseous medium and solvent by said apparatus.

8. The apparatus as recited in claim 5, further comprising refrigeration means disposed in communication with said receptacle for cooling the gaseous medium and solvent in said receptacle.

9. Apparatus for cleaning remnant particles or material from a product, such as densely packaged electrical assemblies, comprising:

a receptacle for containing a liquid cleaning medium;

means rotatable about a substantially horizontal axis mounted in said receptacle for holding a product to be cleaned at least partially submerged in said cleaning medium;

a first directional means disposed in communication with said receptacle below the product being held therein for directing a stream of said cleaning medium upwardly to impinge upon said product; and a second directional means disposed in communication with said receptacle below said product and adjacent to said first directional means for directing a stream of a gaseous medium upwardly to impinge along with said stream of cleaning medium upon said product;

said first and second directional means coacting together so as to cause bubbles of gaseous medium to be driven into and through the product by said cleaning medium and to cause said streams to rotate said product, said streams and rotation, in turn, causing said mediums to repeatedly flow into and out of the product and thereby cause dislodgement and removal of remnant material from the product.

10. Apparatus for cleaning remnant particles or materials from a product, such as densely packaged electrical assemblies, comprising:

a receptacle for containing a cleaning liquid;

means mounted in said receptacle for dividing said receptacle into first and second reservoirs and providing a path of flow of excess liquid from said first to said second reservoir;

means mounted in said receptacle for holding a product for rotation about an axis of rotation and at least partially submerged in said cleaning liquid to be cleaned in said first reservoir of said receptacle;

first directional means connected in communication with said receptacle for directing a stream of a gaseous medium to bubble through said cleaning liquid and impinge upon said product perpendicular to said axis of rotation; and second directional means connected in communication with said receptacle and positioned adjacent said first directional means for directing a stream of said cleaning liquid to impinge on said product and cause said bubbles to be driven into and through the product;

said first and second directional means being operable as said product is rotated to cause portions of said introduced gaseous medium and cleaning liquid to repeatedly flow into and out of said product in a single direction through said first reservoir so as to cause remnant material to be dislodged and removed from the product and to flow with excess fluid along said path from said first to said second reservoir of said receptacle.

11. The apparatus as recited in claim 10, wherein:

said first directional means includes a conduit which extends into said first reservoir of said receptacle below the product held therein, said conduit having at least one opening therein facing upwardly toward the product through which said gaseous medium is directed in said first reservoir; and said second directional means includes a conduit which extends into said first reservoir of said receptacle, below the product held therein and adjacent said conduit of said first directional means, said conduit of said second directional means having at least one opening therein facing upwardly toward the product through which said stream of cleaning liquid is directed in said first reservoir.

12. The apparatus as recited in claim 10, further comprising means disposed in communication with said receptacle and connected to said first directional means for providing return to said first directional means of said stream of gaseous medium so that said first directional means can reintroduce the same gaseous medium to said first reservoir of said receptacle.

13. The apparatus as recited in claim 12, wherein said gaseous medium return means includes a conduit which extends into said receptacle to above the level of said liquid contained therein and has an opening therein above the level of said liquid through which said gaseous medium can flow from said receptacle to said first directional means.

14. The apparatus as recited in claim 10, further comprising means disposed in communication with said receptacle and connected to said second directional means for providing return of said liquid from said second reservoir of said receptacle to said second directional means so that said second directional means can reintroduce the same liquid to said first reservoir of said receptacle.

15. The apparatus as recited in claim 14, wherein said liquid return means includes a conduit which extends into said second reservoir of said receptacle and has an opening therein through which said liquid can flow from said second reservoir to said second directional means.

16. The apparatus as recited in claim 10, further comprising means connected to said receptacle in said second reservoir thereof and disposed adjacent said path of liquid flow from said first to said second reservoir for collecting remnant material removed from the product.

17. The apparatus as recited in claim 10, wherein said receptacle has first and second oppositely inclined bottom wall portions and a third arcuately-shaped bottom wall portion which is lower than and merges with said first and second bottom wall portions and provides a region for collection of remnant material removed from the product.

18. The apparatus as recited in claim 17, wherein said receptacle dividing means is an upright wall which extends across said receptacle and is spaced above and to one side of said third bottom wall portion of said receptacle such that said first bottom wall portion forms the bottom of said first reservoir and said second and third bottom wall portions form the bottom of said second reservoir, said spaced relationship of said upright wall above said third bottom wall portion providing therebetween a flow path for excess liquid and remnant particles therewith from said first reservoir to said collection region formed by said third bottom wall portion of said second reservoir.

19. The apparatus as recited in claim 10, further comprising refrigeration means disposed in communication with said reservoirs of said receptacle for cooling said gaseous medium and liquid contained in said receptacle.

20. The apparatus as recited in claim 10, further comprising a cover for opening and closing said receptacle to exterior atmosphere.

21. The apparatus as recited in claim 10, wherein said first directional means includes:

a blower;

a first conduit connected to said blower and extending therefrom into said first reservoir of said receptacle, said first conduit having a portion disposed in said first reservoir below the product held therein with at least one opening formed in said portion so as to face upwardly toward said product; and a second conduit connected to said blower and extending therefrom into said receptacle, said second conduit having a portion disposed in said receptacle above the level of said liquid contained therein with at least one opening formed in said portion;

said blower being operable to cause said gaseous medium to flow under pressure through said first conduit and to and through said opening of said first conduit portion for directing a stream of said gaseous medium into said first reservoir to impinge upon the product held therein, said blower being simultaneously operable to create a suction flow of said gaseous medium from said receptacle through said opening of said second conduit portion and through said second conduit for providing return to said blower of said gaseous medium so that said blower can cause reintroduction of the same to said first reservoir.

22. The apparatus as recited in claim 10, wherein said second means includes:

a pump;

a filter connected in communication with said pump;

a first conduit connected to said filter and extending therefrom into said first reservoir of said receptacle, said first conduit having a portion disposed in said first reservoir below the product held therein with at least one opening formed in said portion so as to face upwardly toward the product; and a second conduit connected to said pump and extending therefrom into said second reservoir of said receptacle, said second conduit having an opening therein;

said pump being operable to cause said liquid to flow under pressure through said filter and said first conduit and to and through said opening of said first conduit portion for directing a stream of said liquid into said first reservoir to impinge upon the product held therein, said pump being simultaneously operable to create a suction flow of said liquid from said second reservoir of said receptacle through said opening of said second conduit and through said second conduit for providing return to said pump of said liquid so that said pump can cause reintroduction of said liquid, after its filtering by said filter, to said first reservoir.

23. The apparatus as recited in claim 10, wherein said receptacle dividing means includes:

an upright wall portion which extends across said receptacle so as to divide the same into said first and second reservoirs; and an arcuate-shaped wall portion which is connected to and extends from an upper end of said upright wall portion to a region of said second reservoir remotely-located from said first reservoir so as to provide a path of generally laminar flow of excess liquid and remnant particles therewith from said first to said second reservoir.

24. Apparatus for cleaning remnant particles or materials from a product, such as densely packaged electrical assemblies, comprising:

a receptacle for containing cleaning fluid;

means mounted in said receptacle for dividing said receptacle into first and second reservoirs and providing a path of flow of excess fluid from said first to second reservoir, said receptacle dividing means including an upright wall portion which extends across said receptacle so as to divide the same into said first and second reservoirs, and an arcuate-shaped wall portion which is connected to and extends from an upper end of said upright wall portion to a region of said second reservoir remotely-located from said first reservoir so as to provide said path a generally laminar flow of excess fluid and remnant particles therewith from said first to second reservoir;

means connected to said receptacle in said second reservoir at said remotely-located region thereof and disposed adjacent said path of fluid flow from said arcuate-shaped portion into said second reservoir for collecting remnant material from said flow of excess fluid;

means mounted to said receptacle for holding a product to be cleaned in said first reservoir of said receptacle;

first means connected in communication with said receptacle for introducing a gaseous medium into said first reservoir of said receptacle; and second means connected in communication with said receptacle for introducing cleaning fluid into said first reservoir of said receptacle;

said first and second means being operable to cause portions of said introduced gaseous medium and cleaning fluid to impinge against the product so as to cause remnant material to be dislodged and removed from the product and flow with excess fluid along said path from said first to second reservoir of said receptacle.

25. A method of cleaning remnant particles or material from a product, such as densely packaged electrical assemblies, comprising the steps of:

mounting a product to be cleaned in a first reservoir of a receptacle which contains a cleaning liquid in which said product is partially submerged;

rotating said product about an axis of rotation;

directing a stream of a gaseous medium to impinge upon said product perpendicular to said axis of rotation;

directing a stream of said cleaning liquid under pressure into said first reservoir to impinge upon said product perpendicular to said axis of rotation along with said stream of a gaseous medium to drive bubbles of said gaseous medium into and out of said product in a single direction through said product and to drive bubbles trapped within said product back out of said product as said product is rotated to thus remove remnant material therefrom and cause flow of said remnant material along with excess liquid from said first reservoir to a second reservoir of said receptacle; and recirculating said excess liquid from said second reservoir for reintroduction into said first reservoir.

26. The method as recited in claim 25, further comprising the step of recirculating said gaseous medium from said receptacle for reintroduction into said first reservoir thereof.

27. The method as recited in claim 25, further comprising the step of collecting with said second reservoir the remnant material removed from the product.

28. The method as recited in claim 25, wherein said impingement of gaseous medium and cleaning liquid upon the product causes rotation thereof.

29. The method as recited in claim 28, wherein said streams of gaseous medium and cleaning liquid are directed upwardly in said first reservoir toward an underside of said product.

* * * * *